US006543766B2

(12) United States Patent
Neri et al.

(10) Patent No.: US 6,543,766 B2
(45) Date of Patent: Apr. 8, 2003

(54) DEVICE FOR FORMING AND TRANSFERRING ORDERED STACKS OF BANK NOTES

(75) Inventors: Armando Neri, Bologna (IT); Paul Gray, Garland, TX (US)

(73) Assignee: Currency Systems International, Irving, TX (US)

( * ) Notice: Subject to any disclaimer, the term of this patent is extended or adjusted under 35 U.S.C. 154(b) by 32 days.

(21) Appl. No.: 09/853,900

(22) Filed: May 14, 2001

(65) Prior Publication Data

US 2002/0003330 A1 Jan. 10, 2002

(30) Foreign Application Priority Data

May 12, 2000 (IT) ..... BO2000A0279

(51) Int. Cl.[7] ..... B65H 31/10

(52) U.S. Cl. ..... 271/217; 271/207; 271/315; 271/195

(58) Field of Search ..... 271/207, 210, 271/214, 215, 217, 220, 315, 195; 100/190

(56) References Cited

U.S. PATENT DOCUMENTS 3,441,268 A * 4/1969 Hanson ..... 271/210
4,511,136 A * 4/1985 Yamada et al. ..... 271/315
4,577,853 A * 3/1986 Duke ..... 271/217
4,616,817 A 10/1986 Yamauchi et al.
5,092,575 A * 3/1992 Ramsey ..... 271/215
5,112,042 A * 5/1992 Tilles et al. ..... 271/215
5,295,674 A * 3/1994 Zoltner ..... 271/215
5,499,805 A 3/1996 Anma

FOREIGN PATENT DOCUMENTS

EP 0 811 956 A2 12/1997
GB 2337988 12/1999

* cited by examiner

*Primary Examiner*—H. Grant Skaggs
(74) *Attorney, Agent, or Firm*—Colin P. Cahoon; Carstens, Yee & Cahoon, LLP

(57) ABSTRACT

Bank notes arriving from a control machine are fed along a feed pipe which has a plurality of outfeeds, each connected to an infeed zone of a forming channel along which an accompanying element moves, equipped with a surface on which the bank notes are rested, on top of one another, by a rotary drum located between each outfeed and the respective infeed zone, forming an ordered stack. Close to the infeed zone each forming channel has a shielding wall which is mobile between a non-operating position in which the infeed zone is open, and a position in which the latter is partially closed, limiting the inflows of air which facilitate bank note feed along the pipe and the inflows of air generated by rotation of the drum. A vibrating plate on a side wall of the channel and close to the infeed zone of the channel facilitates correct bank note stacking.

12 Claims, 7 Drawing Sheets

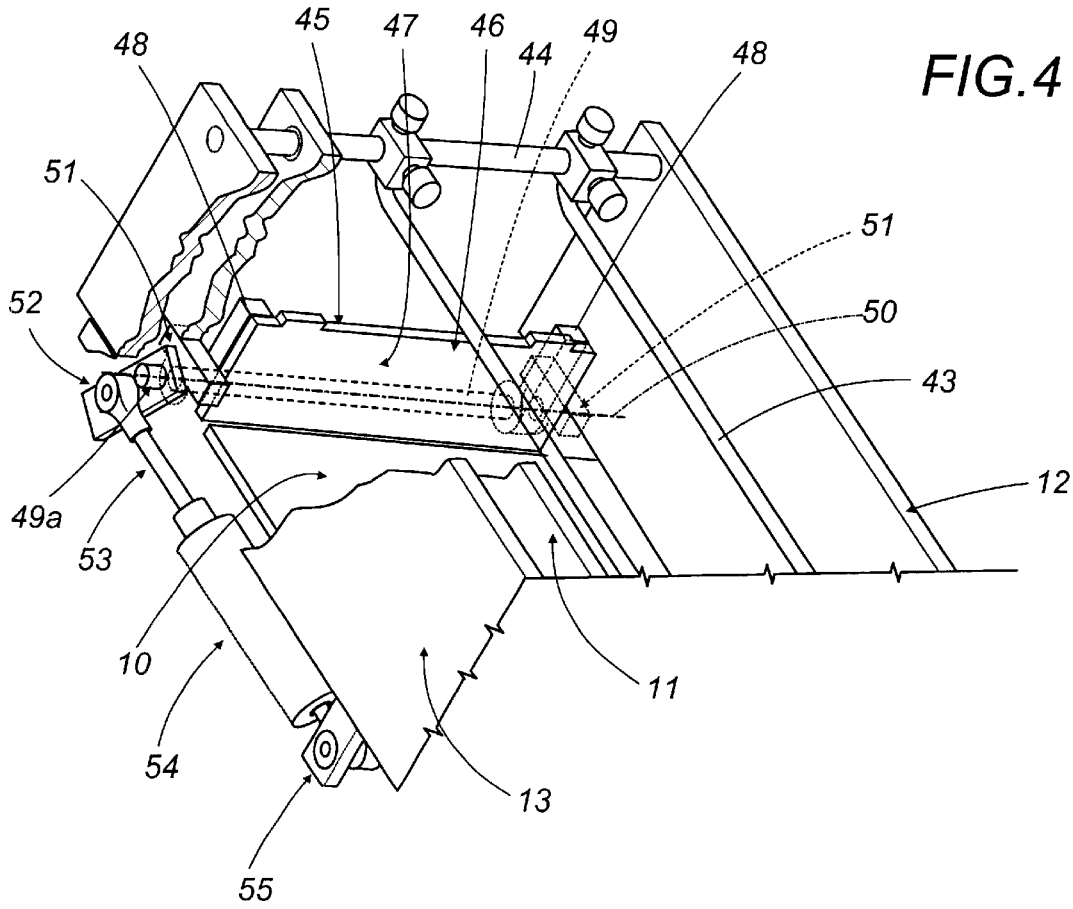
FIG.4
FIG.5
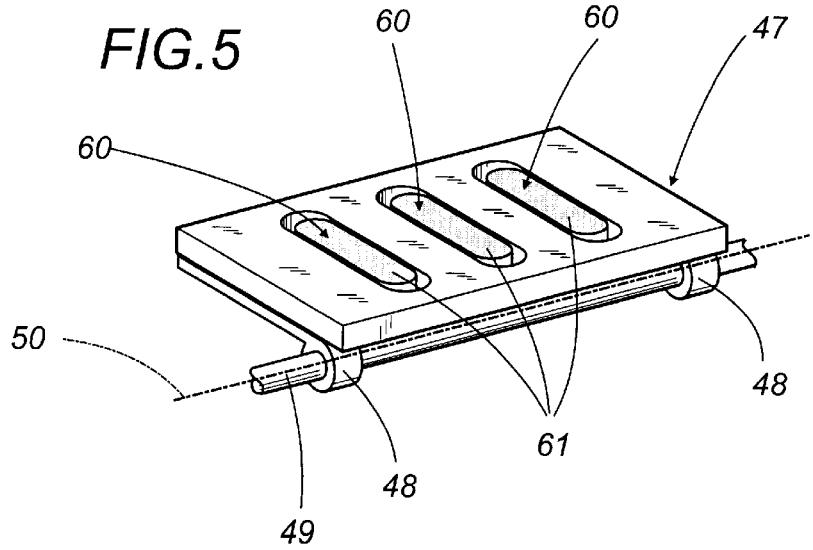

DEVICE FOR FORMING AND TRANSFERRING ORDERED STACKS OF BANK NOTES

BACKGROUND OF THE INVENTION

The present invention relates to a device for forming and transferring ordered stacks of bank notes.

The present invention is advantageously applied on machines which arrange bank notes then package them in bundles or groups of bundles, to which the following description refers, without limiting the scope of the invention.

The bank note control machines currently known comprise a main feed pipe, with substantially horizontal axis, the infeed of which is loaded with a succession of bank notes of any type and value. The bank notes are checked individually along the main channel and, following the elimination of any defective notes, are divided according to value and/or type and sent to relative main channel outfeeds, each independent of the others.

At each outfeed the bank notes are picked up individually and in succession by a pick up and transfer element which comprises a drum which rotates about an axis of rotation transversal to the axis of the main pipe. The edge of the drum has a plurality of seats designed to hold individual bank notes, feeding the bank notes to the infeed of a forming channel equipped with an accompanying element. The bank notes are rested on the accompanying element, on top of one another, so as to form stacks.

Normally, at least at each of the outfeeds from the main pipe, the feed of individual bank notes to the rotary drum and to the infeed of the relative forming channel is facilitated by air flows directed in the direction of feed of the bank notes.

Although facilitating bank note feed, it has been noticed that these air flows create turbulence along the forming channel, which may cause the bank notes to be incorrectly positioned on the accompanying element.

This disadvantage is made worse by further turbulence generated by the high speed of rotation and special geometrical configuration of each of the pick up and transfer drums, which may overturn some bank notes and even cause blockage of the forming channel infeed.

SUMMARY OF THE INVENTION

The aim of the present invention is to eliminate this type of disadvantage, by providing a device for forming and transferring ordered stacks of bank notes which can guarantee correct stacking and transfer of the stacks along the forming channel.

Accordingly, the present invention provides a device for forming and transferring ordered stacks of bank notes supplied by a control machine and comprising an outfeed pipe along which the bank notes are fed in succession to the infeed of at least one forming channel comprising a base and two side walls which retain the bank notes supplied individually and in succession to the forming channel infeed by a rotary transfer device located between the outfeed pipe and the forming channel, and designed to place the bank notes on top of one another, according to a stacking axis, defining the stack on an accompanying element. The accompanying element is mobile along the forming channel and the device is characterized in that it comprises shielding means located at the forming channel infeed.

BRIEF DESCRIPTION OF THE DRAWINGS

The invention will now described with reference to the accompanying drawings, which illustrate preferred embodiments of the invention without limiting the scope of its application, and in which:

FIG. 4 is a schematic perspective view of a detail from FIG. 2;

FIG. 5 is a schematic perspective view of an alternative embodiment of a detail from FIG. 2;

DESCRIPTION OF THE PREFERRED EMBODIMENTS

Figure 1:
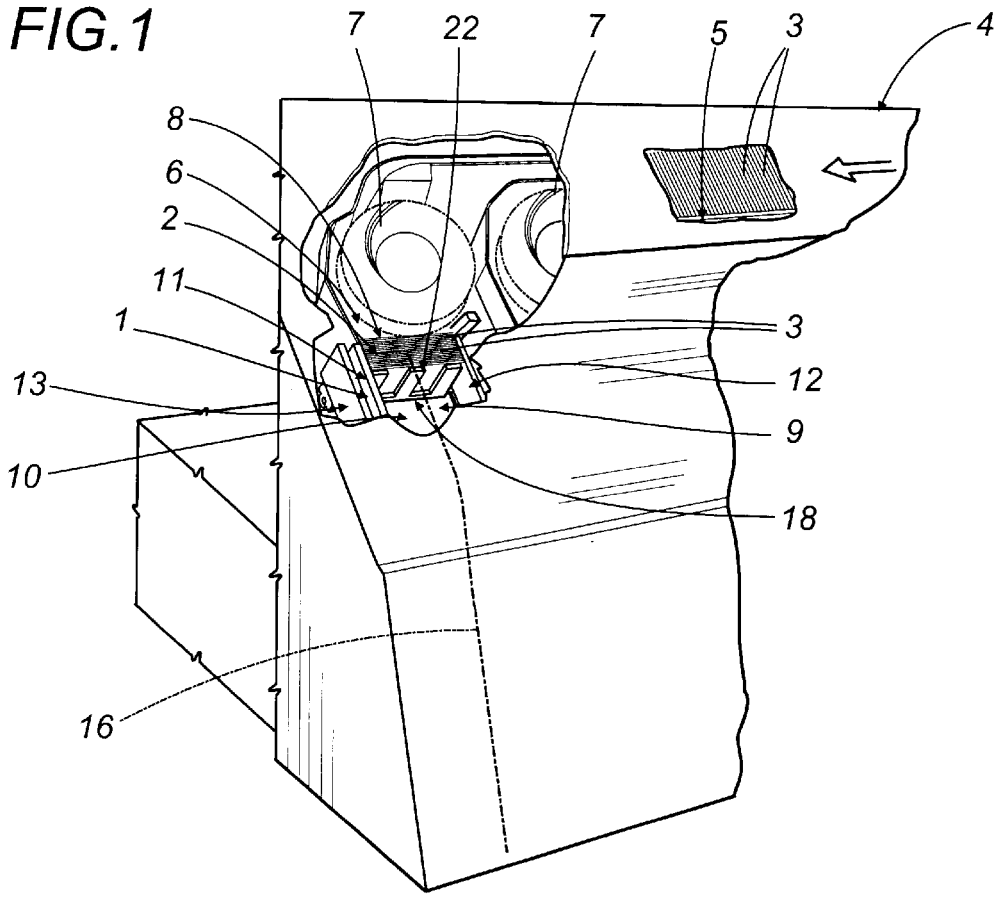
FIG. 1 is a schematic perspective view, with some parts in cross-section and some parts cut away to better illustrate others, of a portion of a machine for arranging and checking bank notes, equipped with a device for forming and transferring ordered stacks of bank notes made in accordance with the present invention.

With reference to FIG. 1, the numeral 1 indicates a device for forming and transferring ordered stacks 2 of sheets, in particular bank notes 3 arriving from the outfeed of a machine 4 (only part of which is schematically illustrated in FIG. 1) which checks the bank notes, rejecting any defective or damaged ones.

As illustrated in FIG. 1, the bank notes 3 are fed along a main feed pipe 5 and, once they reach one of the pipe 5 outfeeds 6, are picked up by rotary transfer drums 7 of the known type, each of which feeds a succession of bank notes 3 to an infeed zone 8 of one of the devices 1 fitted on the machine 4.

Each device 1 in turn forms stacks 2 of bank notes 3 and feeds them to a banding machine, of the known type and therefore not illustrated.

Each device 1 comprises a stack 2 forming channel 9, extending transversally to the pipe 5, from top to bottom, and located at a relative outfeed 6 of the bank note 3 feed pipe 5, downstream of the respective drum 7.

Figure 2:
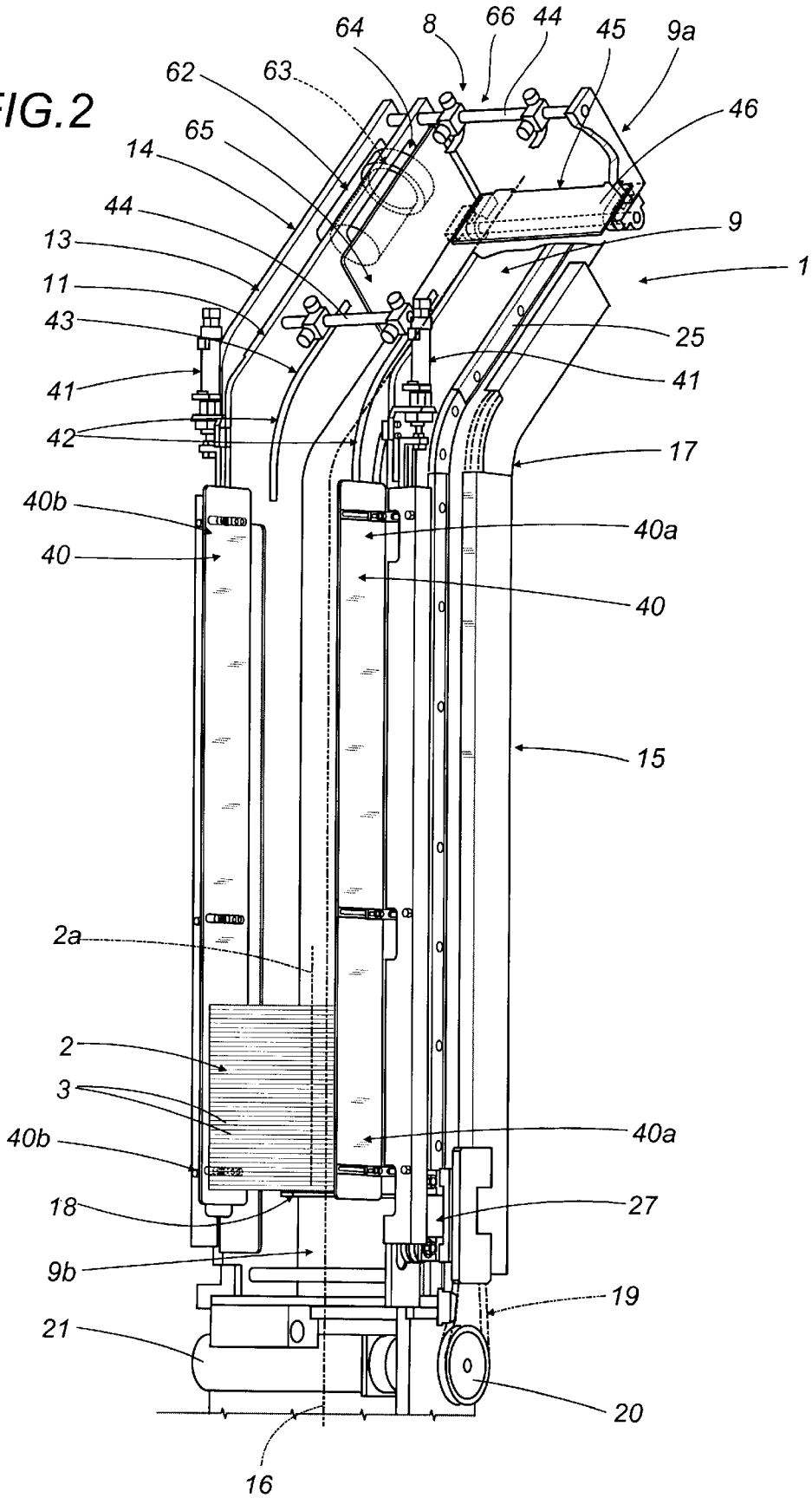
FIG. 2 is a schematic perspective view, with some parts cut away for greater clarity, of a part of the machine illustrated in FIG. 1.

As illustrated in FIG. 2, each device 1 consists of a base 10, two side walls 11, 12 and a support surface 13 which extends parallel with the side wall 11 outside the forming channel 9.

The forming channel 9 consists of two parts 14, 15, connected discontinuously and extending along a longitudinal axis 16. The two parts 14, 15 are at an angle to the vertical plane and are connected to one another by a curved connecting section 17. In particular, the first, upper part, labelled 14, is set at a downward angle rather than vertical, whilst the second, lower part, labelled 15, is substantially vertical.

As illustrated in FIG. 2, the forming channel 9 comprises an accompanying element 18 which moves along the channel 9, driven by a flexible drive part 19 (for example a chain) looped around two wheels, respectively a driving wheel and a driven wheel, one of which, the lower driving wheel 20, is illustrated in FIG. 2. The two wheels are located at the side of the channel 9 at opposite ends 9*a*, 9*b* of the channel 9, respectively upper and lower. In particular, the driving wheel 20 is driven by an electric motor 21 positioned close to the lower end 9*b* of the forming channel 9.

Figure 3:
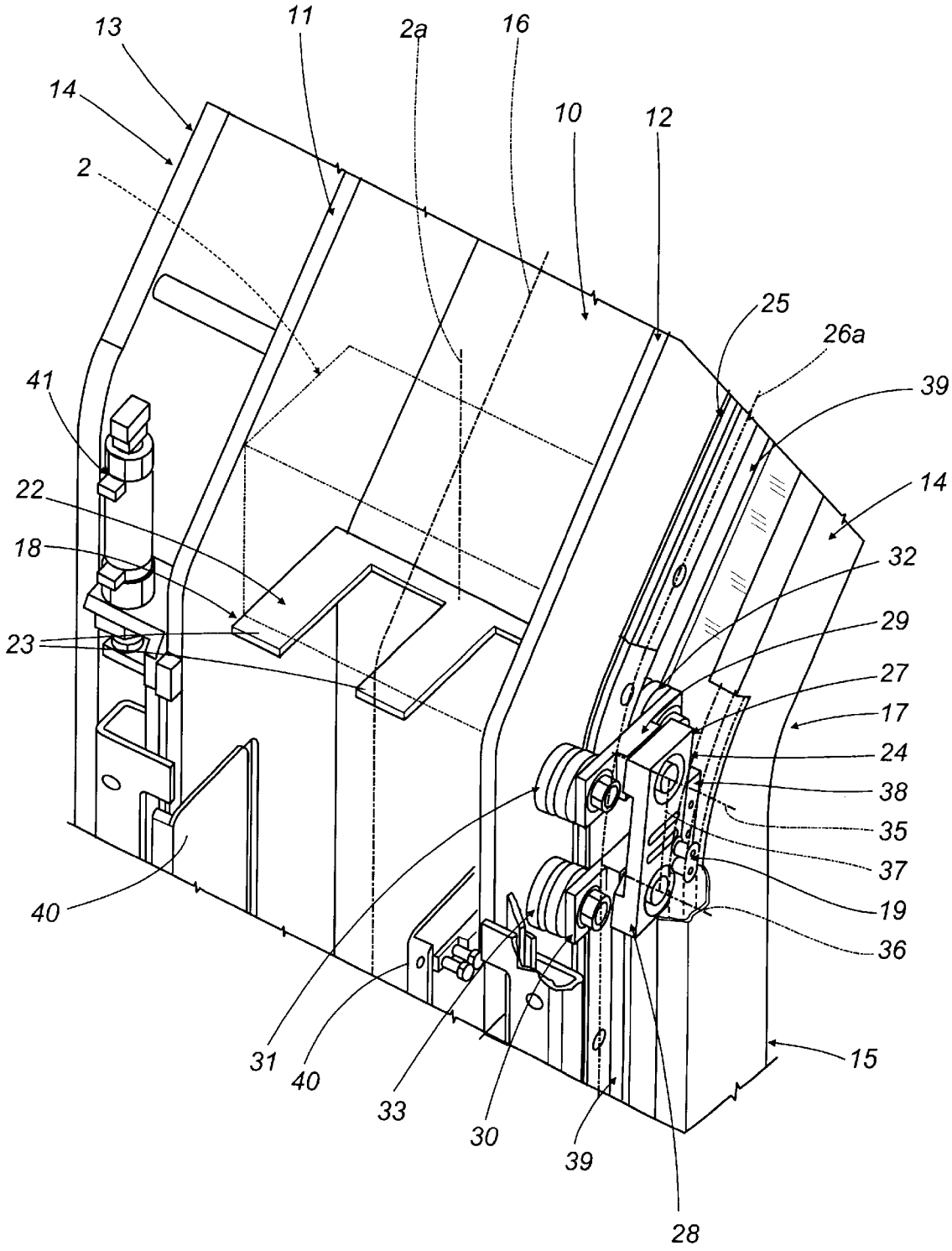
FIG. 3 is a schematic perspective view, with some parts cut away for greater clarity, of a detail from FIG. 2.

As illustrated in FIG. 3, the accompanying element 18 comprises a support surface 22 for the stack 2 of bank notes 3. The bank notes 3 are stacked on the support surface 22 according to a stacking axis 2*a* which is substantially perpendicular to the support surface 22. The surface 22 has tines 23 and the portion facing the side wall 12 has sliding means 24 which allow the accompanying element 18 to move along a guide 25, located on an outer surface of the side wall 12, defining a path 26 which is substantially parallel with the axis 16 of the forming channel 9.

As is also illustrated in FIGS. 6 to 9, the sliding means 24 comprise a carriage 27 with a frame 28 which is rigidly fixed to the surface 22 and two rocker arms 29, 30, each fitted with two respective idle wheels 31, 32 and 33, 34 designed to engage with the sliding guide 25 on opposite sides of the guide 25.

The centre of each arm 29, 30 pivots on the frame 28, at oscillation axes 35, 36 transversal to the channel 9 axis 16, using bearings which are not illustrated, so that they oscillate freely around the axes 35, 36. The distance between the oscillation axes 35 and 36 of the two arms 29 and 30 defines a carriage centre-to-centre distance 37, substantially parallel with the bank note 3 stacking axis 2*a* on the support surface 22.

The connection between the support surface 22 and the carriage 27 is made using rigid connecting parts 38, which slide through a longitudinal slot 39, visible in FIG. 3, made in the side wall 12 and extending substantially parallel with the path 26 along the entire length of the forming channel 9.

With reference to FIG. 2, the straight lower part 15 of the forming channel 9 has two side guides 40 extending longitudinally to retain the bank notes 3 in the stack 2 during stack 2 downfeed towards the lower end 9*b* of the channel 9.

As is more clearly explained below, the side guides 40 can be adjusted according to the length of the bank notes 3 calculated parallel with the base 10 of the channel 9, using actuators 41 of the known type.

Along the forming channel 9, on opposite sides of the base 10 relative to the stack 2, there are bars 42 which extend longitudinally substantially parallel with the axis 16, defining a part 43 which retains the bank notes 3 during their downfeed along the forming channel 9. The bars are supported by a plurality of crosspieces 44 which connect the retaining part 43 to the side walls 11, 12 of the forming channel 9.

Again with reference to FIG. 2, the upper end 9*a* of the forming channel 9 is fitted with a shielding device 45, a generic embodiment of which comprises a wall 46 which limits the entry of air flows from the pipe 5 into the channel 9. The air flows are used in the pipe to help feed the bank notes 3 to the relative drum 7 which, during rotation, produces further air flows which tend to pass along the forming channel 9.

The shielding wall 46 is mobile between a non-operating position in which the forming channel 9 infeed zone 8 is open, illustrated for example in FIG. 2, and an operating position in which the infeed zone 8 is partially closed, illustrated for example in FIG. 4.

As illustrated in FIG. 4, the wall 46 of the shielding device 45 consists of a door 47 which is rigidly connected, by brackets 48, to a shaft 49 extending along an axis 50.

The shaft 49 is connected in such a way that it can rotate, to the base 10 of the channel 9 by means of supports 51 and one end 49*a* of the shaft is fitted with a crank 52 connected to a mobile rod 53 of an actuator 54 pivoted on a bracket 55 which is integral with the base 10 of the forming channel 9.

Figure 11:
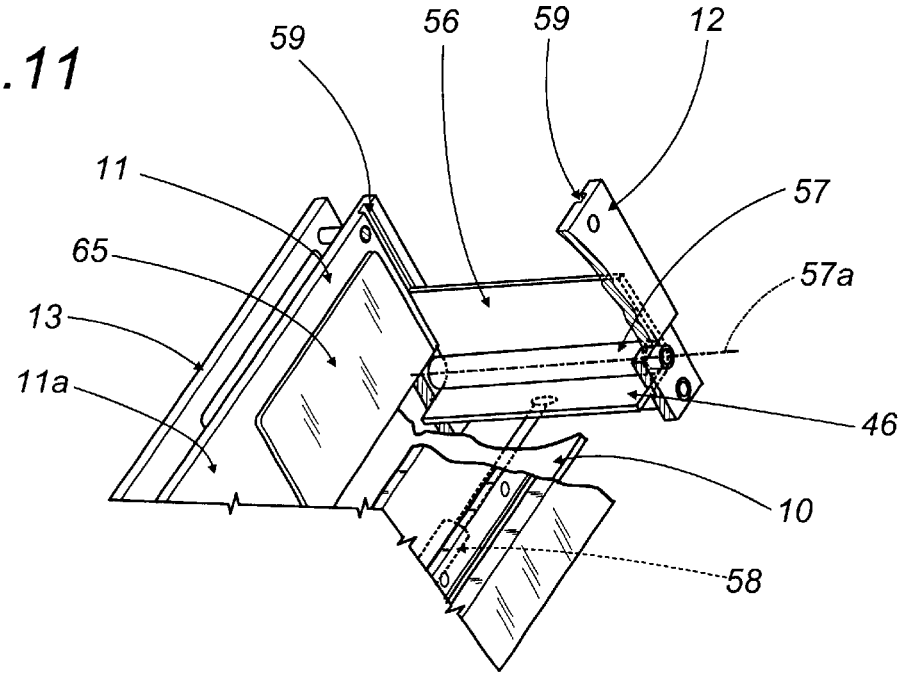
FIG. 11 is a schematic perspective view of an alternative embodiment of the detail shown in FIG. 4.

In the alternative embodiment illustrated in FIG. 11, the shielding wall 46 consists of a roller shutter 56 which slides on a roller 57 supported by the side walls 11, 12 and has an axis 57*a* which is transversal to the axis 16 of the channel 9. The movements of the roller shutter 56 which open and close the infeed zone 8 are driven by an actuator 58, illustrated with a dashed line in the figure, and the lateral edges of the roller shutter engage with special sliding guides 59 in the side walls 11, 12 of the forming channel 9.

In another embodiment, which is not illustrated, the wall 46 consists of two wings respectively hinged on each of the side walls 11, 12 of the forming channel 9.

In the embodiment of the wall 46 illustrated in FIG. 5, the door 47 has a plurality of slots 60 extending transversally to the shaft 49. Inside each slot 60 there are vibrating elements 61, schematically illustrated in the figure and aiding correct bank note 3 stacking.

As illustrated in FIG. 2, close to the forming channel 9 infeed zone 8, there is a vibrating device 62 which, similarly to the vibrating elements 61 on the door 47, aids correct positioning and compacting of the bank notes 3 during the stack 2 forming stage.

The vibrating device 62 comprises a source 63 of vibrations, located between the side wall 11 and the support surface 13, the source 63 being in contact, through an opening 64 in the side wall 11, with a rectangular plate 65.

As is clearly illustrated in FIG. 11, the plate 65 is connected to an inner surface 11*a* of the wall 11 facing the forming channel 9, is parallel with the wall 11 and is caused to vibrate by the source 63 with which it is in contact.

For the stack 2 being formed, the vibrating device 62 and the retaining part 43 together define positioning and compacting means 66 which co-operate with the side walls 11, 12 and the base 10.

Figure 12:
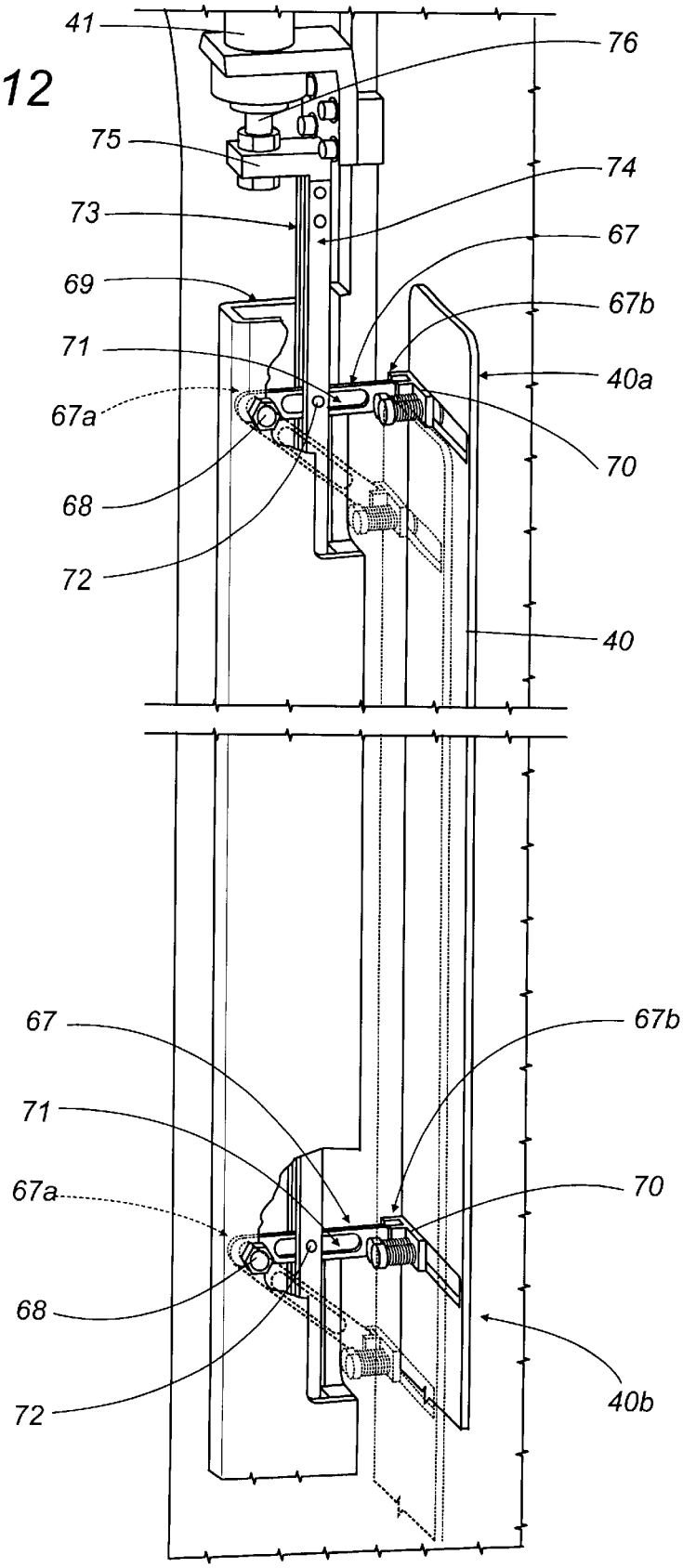
FIG. 12 is a schematic perspective view of a detail from FIG. 2.

With reference to FIG. 12, the opposite ends 40*a*, 40*b* of the guide 40 are connected to two cranks 67, which pivot at their first end 67*a* on pins 68 which are integral with a longitudinal box-shaped support and protection element 69, and at their second end 67*b* on brackets 70 which are integral with the guides 40.

The central section of each crank 67, between the two ends 67*a*, 67*b*, has slots 71 in which pins 72 connecting two rods 73, 74 which extend longitudinally parallel with one another and with the guide 40 engage in such a way that they can slide.

The rods 73, 74 are separated transversally, in such a way that the cranks 67 pivoted on the pins 68 can slide in the space between them.

The tops of the rods 73, 74 are fixed to a single bracket 75, which is connected to the mobile rod 76 of an actuator 41 integral with the side wall 11, 12 of the forming channel 9.

In practice, as illustrated in FIGS. 1 and 2, the accompanying element 18 moves along the channel 9 between two end operating positions, namely, a first position for receiving the bank notes 3 at the upper end 9*a* of the channel 9 and a second position for releasing the stack 2 at the lower end 9*b* of the channel 9. In the receiving position illustrated in FIG. 1, the accompanying element 18 is at the outfeed 6 of the feed pipe 5 and receives the bank notes 3 which are gradually laid on top of one another on the surface 22 to form a stack 2.

To facilitate the formation of a stack 2 of bank notes 3, the accompanying element 18 may, at least at its first, receiving position, perform a gradual downward movement depending on the number of bank notes 3 gradually released onto the surface 22. In other words, the gradual downward movement defines a series of intermediate positions for the accompanying element 18 as the stack 2 is formed, so that the last bank note 3 in the stack 2 is always at the same distance from the feed pipe 5 outfeed 6.

With reference to FIGS. 1 and 2, the parts constituting the vibrating device 62 act upon the bank notes 3 stacked on the support surface 22 positioned close to the forming channel 9 infeed zone 8.

As illustrated in FIG. 11, the plate 65 is made to vibrate by the source of vibrations 63 illustrated with a dashed line in FIG. 2 and transmits its vibrations to the bank notes 3 (not illustrated in FIG. 11) which are gradually stacked, promoting correct stack 2 alignment.

Figure 6:
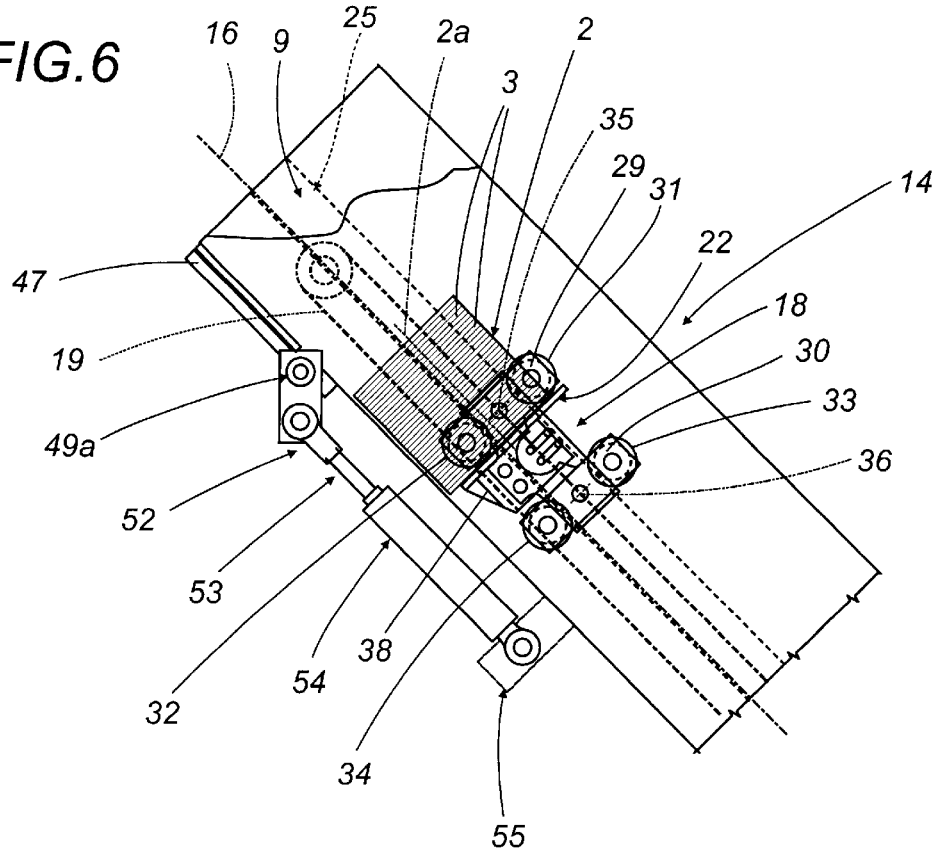
FIGS. 6, 7, 8, 9 and 10 are schematic views of the detail shown in FIG. 3 in a succession of operating stages.
Figure 7:
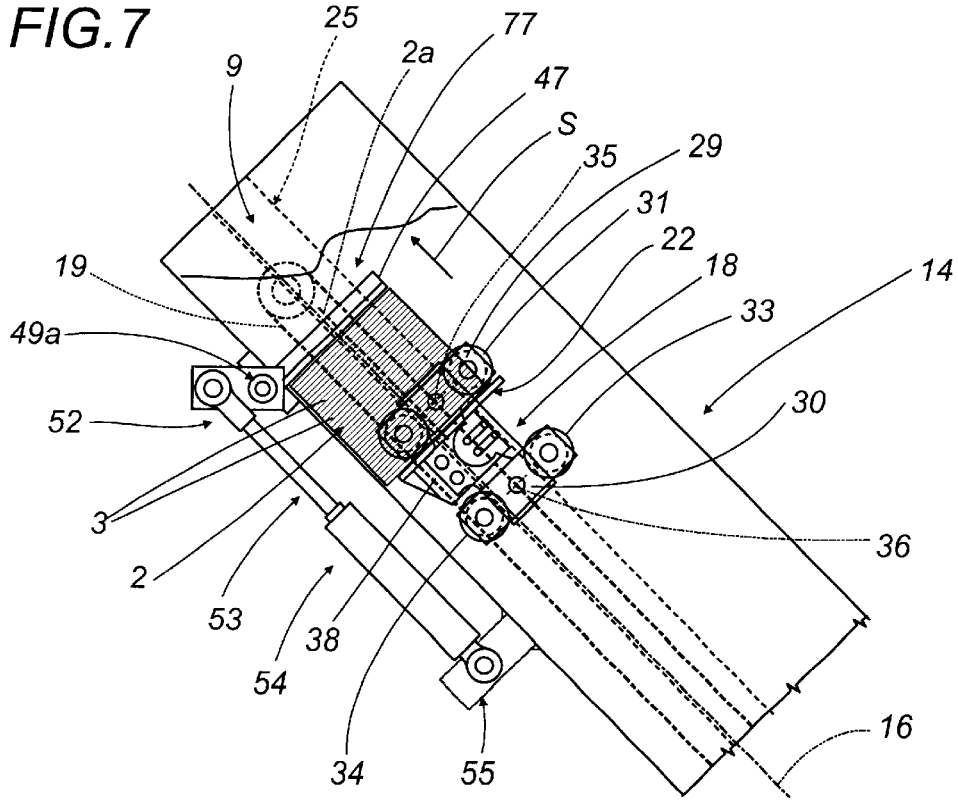

With reference to FIGS. 6 and 7, when a given number of bank notes 3, constituting a stack 2, have been stacked on the surface 22 of the accompanying element 18, the door 47 is moved to its operating position to partially close the forming channel 9 infeed zone 8, driven by the actuator 54, as illustrated in FIG. 7. The accompanying element 18 is then moved over a short distance, driven by the flexible drive part 19, towards the upper part of the channel, in the direction indicated by the arrow S.

During this stage, the mobile door 47 defines contrast means 77 co-operating with the mobile accompanying element 18 to compact the stack 2 of bank notes 3.

FIGS. 6 and 7 clearly illustrate how, when travelling along the upper part 14 of the forming channel 9, the carriage 27 keeps the stack 2 with its stacking axis 2*a* substantially parallel with the axis 16 of the forming channel 9.

Figure 8:
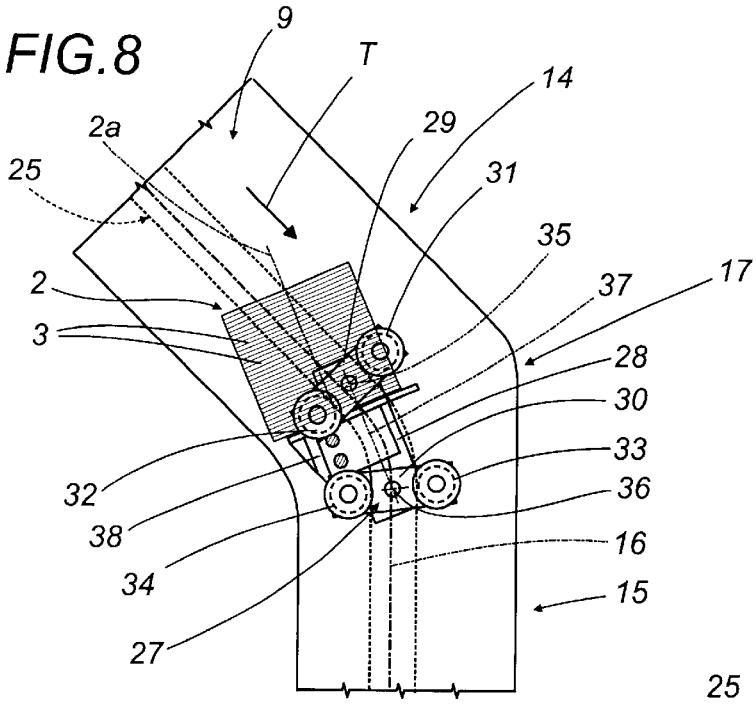

As illustrated in FIG. 8, following stack 2 compacting by counteracting the door 47, the accompanying element 18 continues its movement from top to bottom, as indicated by the arrow T.

When, again with reference to FIG. 8, the carriage 27 reaches the curved section 17 connecting the two parts 14 and 15 of the channel 9, the wheels 33, 34 of the arm 30 cover the curved section, whilst the wheels 31, 32 of the arm 29, which are upstream of the wheels 33, 34 with reference to the direction T of travel along the channel 9, are still running over a section of the guide 25 belonging to the upper, straight part 14 of the channel 9. In this configuration, the center distance 37, which coincides with the frame 28 axis assumes in succession a series of positions defining chords subtending the axis 16 in the curved section 17 of the channel 9.

Figure 9:
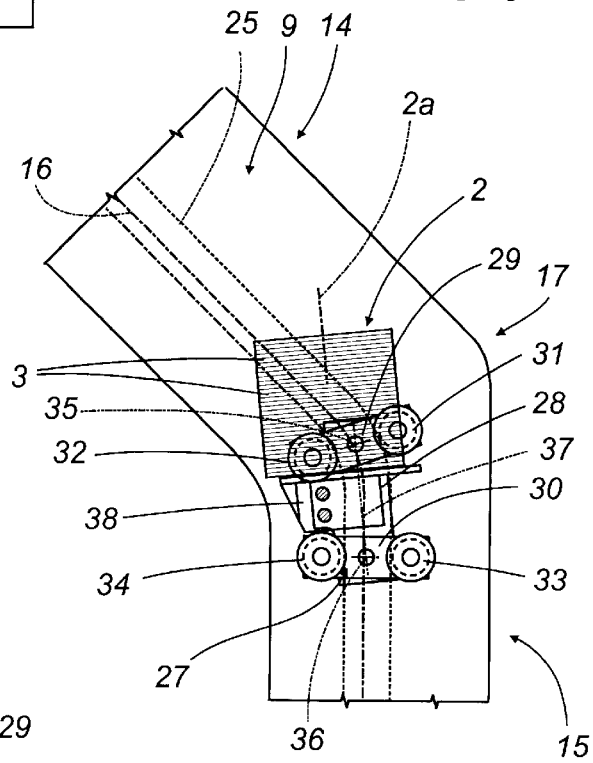
Figure 10:
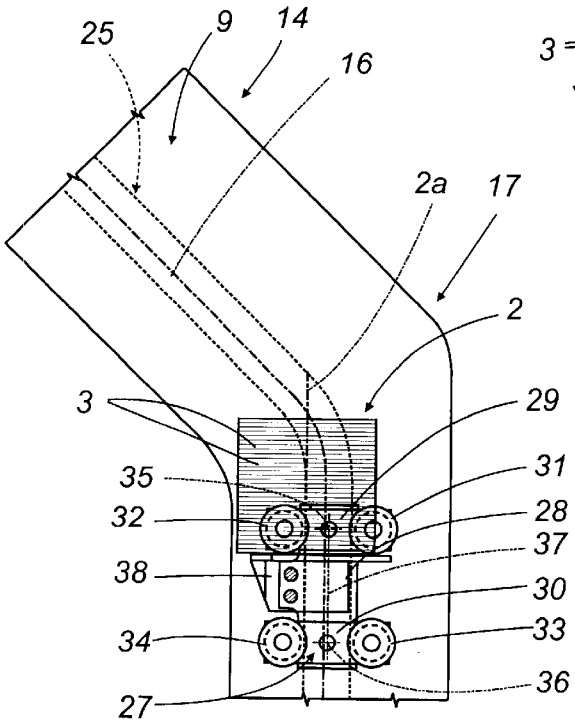

The above also happens to the center distance 37 when, as is clearly illustrated in FIG. 9, the wheels 33, 34 of arm 30 downstream begin to travel over the section of the guide 25 belonging to the straight lower part 15 of the channel 9, whilst the wheels 31, 32 of the arm 29 upstream are still travelling over the curved section 17. There is, therefore, a section of the guide 25 along which the stacking axis 2*a* for bank notes 3 on the support surface 22 is temporarily at an angle to the axis of the forming channel 9, and the length of this section is greater than the length of the curved intermediate section 17 of the forming channel 9.

In other words, the presence of a given center distance 37 between the axes 35, 36 of the two arms 29, 30 which support the wheels 31, 32, 33, 34 and the location of the parts 38 which connect the support surface 22 to the carriage 27 in a substantially intermediate position relative to the center distance 37 mean that the variation in the bank note 3 stacking axis 2*a* performed in order to follow the axis 16 of the channel 9 takes longer than the time needed for the central portion of the carriage 27 to cover the curved section 17 of the channel 9. This means that the angular acceleration to which the bank notes 3 are subjected while the carriage 27 travels over the curved section 17 is significantly reduced relative to a carriage with only one wheel support arm, thus improving the stability of the stack 2 of bank notes 3 over the path 26 along the channel 9.

The frame 28 and rocker arms 29 and 30 together constitute means 78 for adjusting the angle of the stack 2 axis 2*a* relative to the forming channel 9 axis 16.

Moreover, by oscillating about respective axes 35, 36, the arms 29, 30 assist the movement of the carriage 27, above all in the curved section, facilitating wheel 31, 32, 33, 34 engagement with the sliding guide 25.

As illustrated in FIG. 12, each side guide 40 constitutes the connecting rod of a four-bar linkage whose cranks are the cranks 67.

The movements of the actuator 41 mobile rod 76, the longitudinal rods 73, 74 being integral with the rod 76, turn the cranks 67, which, in accordance with the four-bar linkage kinematic effect, pull the guide 40 with a translation motion, so that it takes up successive parallel positions.

The possibility of the guides 40 assuming said different positions, two of which are illustrated in FIG. 12, with a continues line and a dashed line respectively, guarantees the possibility of adapting the device 1 for handling bank notes 3 of different sizes.

What is claimed:

1. A device for forming and transferring ordered stacks of bank notes fed from a control machine, having a feed pipe along which the bank notes are fed in succession to the infeed of at least one forming channel with a base and two side walls for retaining the bank notes fed individually and in succession to the infeed of the forming channel by a rotary transfer part located between the feed pipe and the forming channel and designed to place the bank notes forming the stack on top of one another, according to a stacking axis, on an accompanying element, the latter being mobile along the forming channel, the device comprising shielding means, at the infeed of the forming channel, to limit air flow from the feed pipe into the at least one forming channel.

2. The device according to claim 1, wherein the shielding means comprise at least one wall, being mobile between a non-operating position in which the infeed of the forming channel is open and an operating position in which the infeed is partially closed.

3. The device according to claim 2, wherein the mobile wall defines contrast means cooperating with the mobile accompanying element to compact the stack of bank notes.

4. The device according to claim 2, wherein the mobile wall comprises at least one door, oscillating about a shaft positioned transversally to a longitudinal axis of the forming channel.

5. The device according to claim 2, wherein the mobile wall comprises a roller shutter, moving transversally to the forming channel longitudinal axis, between two operating positions, one for opening and the other for partial closing of the forming channel.

6. The device according to claim 1, comprising means for positioning and compacting the stack of bank notes, the means being located at the forming channel infeed.

7. The device according to claim 6, wherein the positioning and compacting means comprise vibrating means located at least on one side of the three walls of the forming channel.

8. The device according to claim 7, wherein the vibrating means comprise a plate located at the forming channel infeed and connected to a source of vibrations.

9. The device according to claim 1, where the forming channel has at least two parts which ate substantially straight, at different angles and connected to one another by a curved intermediate section, wherein the accompanying element can move along a guide running parallel with the axis of the forming channel and comprises a support surface for a stack whose stacking axis is substantially perpendicular to the support surface, the support surface being connected to means which slide along the guide, the sliding means comprising means for adjusting the angle of the support surface to the axis of the forming channel.

10. A device for forming and transferring ordered stacks of bank notes fed from a control machine, having a feed pipe along which the bank notes are fed in succession to the infeed of at least one forming channel with a base and two side walls for retaining the bank notes fed individually and in succession to the infeed of the forming channel by a rotary transfer part located between the feed pipe and the forming channel and designed to place the bank notes forming the stack on top of one another, according to a stacking axis, on an accompanying element, the latter being mobile along the forming channel, the device comprising shielding means at the infeed of the forming channel, wherein the shielding means comprise at least one wall, being mobile between a non-operating position in which the infeed of the forming channel is open and an operating position in which the infeed is partially closed, wherein the mobile wall comprises at least one door, oscillating about a shaft positioned transversally to a longitudinal axis of the forming channel and wherein the mobile wall comprises a door with two wings, each oscillating about a respective hinge; the hinges being attached to the two opposite side walls of the forming channel.

11. A device for forming and transferring ordered stacks of bank notes fed from a control machine, having a feed pipe along which the bank notes are fed in succession to the infeed of at least one forming channel with a base and two side walls for retaining the bank notes fed individually and in succession to the infeed of the forming channel by a rotary transfer part located between the feed pipe and the forming channel and designed to place the bank notes forming the stack on top of one another, according to a stacking axis, on an accompanying element, the latter being mobile along the forming channel, the device comprising shielding means at the infeed of the forming channel, where the forming channel has at least two parts which are substantially straight, at different angles and connected to one another by a curved intermediate section, wherein the accompanying element can move along a guide running parallel with the axis of the forming channel and comprises a support surface for a stack whose stacking axis is substantially perpendicular to the support surface, the support surface being connected to means which slide along the guide, the sliding means comprising means for adjusting the angle of the support surface to the axis of the forming channel, and wherein the sliding means comprise a carriage which moves along the guide and the adjusting means comprise two rocker arms, each comprising two wheels, each fitted at opposite ends of each of the rocker arms and being located on opposite sides of the guide, the rocker arms pivoting, in such a way that they can oscillate about relative pivoting axes, on a frame element of the carriage, the frame element being connected to the support surface and at least one of the two wheels of each rocker arm engaging temporarily in the guide.

12. The device according to claim 11, wherein the pivoting axes of the rocker arms are separated by a given center distance, the rocker arms being designed to anticipate and delay angling of the axis of the stack relative to the axis of the forming channel in the portions of the straight sections close to the curved connecting section of the forming channel.

* * * * *

UNITED STATES PATENT AND TRADEMARK OFFICE

CERTIFICATE OF CORRECTION

PATENT NO. : 6,543,766 B2
DATED : April 8, 2003
INVENTOR(S) : Neri et al.

It is certified that error appears in the above-identified patent and that said Letters Patent is hereby corrected as shown below:

Column 7,
Line 5, should read: -- channel has at least two parts which are substantially --

Signed and Sealed this

Fifth Day of August, 2003

JAMES E. ROGAN
*Director of the United States Patent and Trademark Office*